US006139060A

United States Patent [19]

Lenhart

[11] Patent Number: 6,139,060

[45] Date of Patent: Oct. 31, 2000

[54] HANDLE FOR A STICK

[76] Inventor: Klaus Lenhart, Jesinger Strasse 84, D-73230, Kirchheim, Germany

[21] Appl. No.: 09/091,412

[22] Filed: Jun. 22, 1998

[30] Foreign Application Priority Data

Dec. 19, 1995 [DE] Germany ..... 29520269 U

[51] Int. Cl.[7] ..... A63C 11/00

[52] U.S. Cl. ..... 280/821

[58] Field of Search ..... 16/436, 421, 143, 16/DIG. 12, DIG. 19; 133/76; D27/775; D3/12; 280/421, 819, 822, 823

[56] References Cited

U.S. PATENT DOCUMENTS

| | | | |
|---|---|---|---|
| 3,556,544 | 1/1971 | Hauser | 280/823 |
| 3,560,014 | 2/1971 | Bruckl | 280/821 |
| 3,658,356 | 4/1972 | Van Reyper | 280/822 |
| 3,685,850 | 8/1972 | Kepka et al. | 280/821 |
| 3,982,747 | 9/1976 | Schweinsberg | 280/822 |
| 4,130,293 | 12/1978 | Hinterreiter | 280/822 |
| 4,162,081 | 7/1979 | Joseph | 280/822 |
| 4,252,344 | 2/1981 | Larsen | 280/822 |
| 4,288,100 | 9/1981 | Aho | 280/821 |
| 4,288,101 | 9/1981 | Aho | 280/821 |
| 4,416,036 | 11/1983 | Aho | 280/821 |
| 4,593,933 | 6/1986 | Nunno | 280/812 |
| 5,758,388 | 6/1998 | Bjerke | 280/821 |

FOREIGN PATENT DOCUMENTS

| | | | |
|---|---|---|---|
| 5906312 | 8/1979 | Germany . | |
| 9218655 | 1/1995 | Germany . | |
| 630919 | 12/1961 | Italy . | |
| 275474 | 8/1951 | Switzerland | 280/821 |

*Primary Examiner*—Brian L. Johnson
*Assistant Examiner*—M. B. Klebe
*Attorney, Agent, or Firm*—Jones, Tullar & Cooper, P.C.

[57] ABSTRACT

A handle for a stick has a hand loop formed by a strap and held in the area of the upper endpiece of the handle. The length of the loop is variable and the loop strap can be secured by means of a clamping device arranged inside the handle endpiece. The clamping device has a clamping element arranged inside the handle endpiece and surrounded by the loop strap. A fixing element adjustable from the outside of the handle extends in a guiding thread in the direction of the axis of the stick through the clamping element and the loop strap. In order to make the clamping device easy to handle without tools and to give an attractive design to the stick handle, a rotary actuating member mounted in the stick handle is coaxially associated and secured against rotation to the fixing element, but in an axially movable manner.

6 Claims, 3 Drawing Sheets

HANDLE FOR A STICK

BACKGROUND OF THE INVENTION

1. Technical Field

The present invention relates to a handle for a hiking stick or ski pole, having a hand loop retained in the region of the upper handle endpiece.

2. Background Art

German Utility Model G 92 18 655.6 discloses a handle for a stick or pole, with a hand loop which is retained in the region of the upper handle endpiece and is formed by a loop strap. The length of the loop can be varied and can be affixed by means of a clamping device disposed in the handle endpiece. To that end, the clamping device has a clamping element, disposed inside the handle endpiece and surrounded by the loop strap. A fixing element guided in a guide thread and adjustable from the outside passes through the clamping element together with the loop strap and extends in the axial direction of the stick or pole.

A disadvantage of this known stick or pole handle is that a tool is needed to adjust the fixing element. Yet precisely in hiking or skiing, an additional tool is undesirable, because it represents one additional burden and in particular is easily lost.

SUMMARY OF THE INVENTION

It is the object of the present invention to provide a remedy for this disadvantage.

This object is attained according to the present invention by a generic handle for a stick or pole having an actuating member supported rotatably in the stick handle, the actuating member being coaxially associated with the fixing element, and the fixing member being connected in a non-rotatable but axially movable manner.

With the present stick or pole handle according to the invention, simple actuation of the fixing element by rotating the actuating member is possible. No additional tool is necessary. The actuating member, and hence the setting of how strongly the loop strap is to be clamped in the handle, can thus be done in any position, for instance even with heavy gloves. The actuating member accessible from the outside of the handle can be designed in a visually striking way, so that the observer of the handle will quickly notice the technology residing in it. This makes the pole or stick handle more attractive.

An annular disk can advantageously be mounted easily in the handle, which as a rule has a small diameter.

An embodiment of the present invention whereby an annular disk positively engages the handle; of the stick or pole ends flush with a circumferential part of the handle; it makes possible a handle with an attractive shape, which makes the overall design then highly aesthetic. In addition, the flush termination averts the risk of injury.

To enable slip-free operation of the annular disk even in damp weather and in snow, knurling to annular disk is contemplated.

By making the actuating member accessible on the side that is oriented toward the palm side of the hand when the handle is in use the actuating member can easily be operated with the thumb, without releasing the stick from the hand.

In an embodiment of the present invention whereby a guide thread is provided in a metal cuff which is introduced into a plastic sheath and press-fitted into the handle, known ski poles or stick handles can be retrofitted to the novel inventive embodiment. Moreover, a metal guide thread prevents the fixing element from being torn out of the thread.

BRIED DESCRIPTION OF THE DRAWINGS

The present invention will be described in detail below in terms of an exemplary embodiment, in conjunction with the drawing. Shown in the drawing are:

FIG. 1, which is a stick or pole handle, in which the upper handle endpiece is shown in section;

FIG. 2, which is a loop strap, shown laid out flat; and

FIG. 3, which is a plan view of the pole or stick handle.

DETAILED DESCRIPTION OF THE PREFERRED EMBODIMENT

Figure 1:
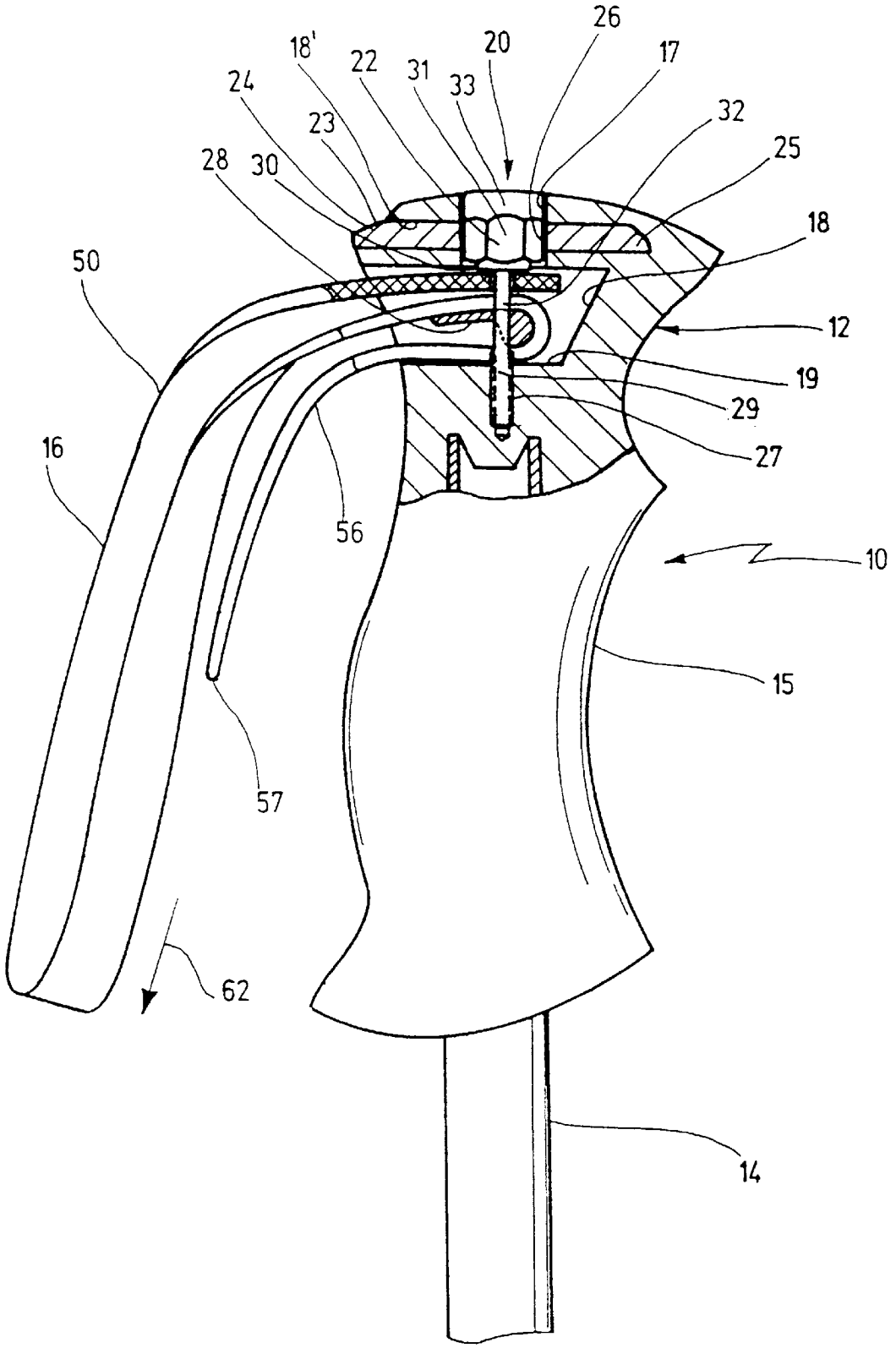

FIG. 1 shows a pole or stick handle 10 mounted on a stick or pole 14. The handle 10 has a handle body 15 with an upper handle endpiece 12. The handle body 15 preferably comprises an inner molded body of hard plastic, such as polyamide, over which a layer of an elastomer that provides a good grip, such as natural rubber, is applied.

The upper handle endpiece 12 has a laterally arranged first recess 18, which is rectangular in cross section and thus has a bottom face 19. The depth of the recess 18 is preferably approximately three quarters the width of the stick or pole handle. The handle 10, between the face end of the handle 10 and the first recess 18, also has a second recess 18', which is introduced into the handle 10 from the same side. A third recess 17 is introduced into the upper handle endpiece 12 axially on the face end, so that there is communication among the three recesses 17, 18, 18'. An axial blind bore with a guide thread 27 is provided in the bottom face 19 of the first recess 18.

The recesses 17, 18, 18' and the guide thread 27 serve to receive a clamping device 20. The clamping device 20 has a fixing element 22, an actuating member 24, and a clamping element 28.

The fixing element 22 preferably comprises a threaded screw 29 with a screw head 31, which is preferably hexagonal or square on its circumference. There is a shoulder 30 between the screw shank 32 and the screw head 31. To elongate the screw head 31, the fixing element 22 also has a guide portion 33, preferably of round cross section.

Figure 3:
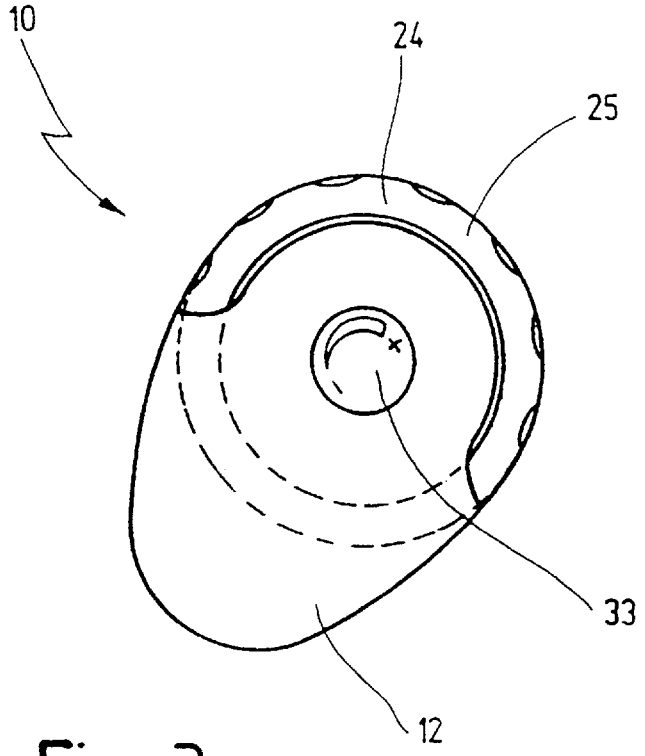

The actuating member 24 is preferably an annular disk 25, which at its center has a hexagonal recess 26 into which the screw head 31 of the fixing element 22 can be inserted with positive engagement. The annular disk 25 can be inserted with positive engagement into the second recess 18' and ends flush with the circumference of the handle, to which end the top of the annular disk 25 has a chamfer 23. The annular disk 25 inserted into the handle 10 is accessible from outside over approximately half its circumference, as shown in FIG. 3. The annular disk 25 is preferably knurled on its circumference.

Figure 2:
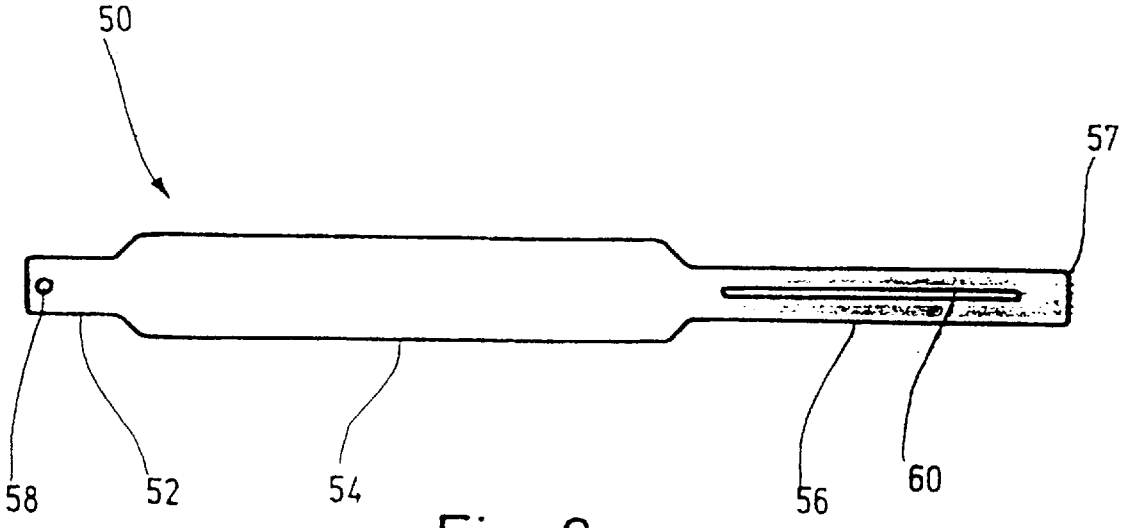

The clamping device 20 is used to retain a hand loop 16 and makes it possible to fix the hand loop in the handle 10 with a variable fixing force. To enable the hand loop 16 to be retained in the clamping device 20, the hand loop 16, when laid out flat, has the shape shown in FIG. 2. The hand loop 16 is formed by a loop strap 50, which has an inner end portion 52 with a hole 58, a middle portion 54, and a slotted end portion 56 with a longitudinally extending slot 60; the two end portions 52 and 56 are narrower than the middle portion 54. The slot 60 does not extend all the way to the end 57 of the loop strap 50.

The inner end portion 52 of the loop strap 50 is retained in the clamping device 20, with the fixing element 22 being guided through the hole 58. The slotted end portion 56 is placed around the clamping element 28, so that the end 57 of the loop strap 50 hangs free out of the first recess 18. The fixing element 22 is guided through the slot 60 of the loop strap 50.

The surface of the clamping element 28 that comes into contact with the slotted end portion 57 of the loop strap 50 is rounded, so that when the loop length is adjusted the loop strap 50 slips easily and without damage over the clamping element 28.

If the actuating member 24 is now rotated, so that the fixing element 22, guided by the guide part 33, guided in turn in the recess 17, and by the guide thread 27 is axially moved and so that the threaded screw 29 is tightened, then via the shoulder 30 of the threaded screw 29 the two end portions 52 and 56 and also the clamping element 28 are pressed against the bottom face 19 of the first recess 18 and tensed against one another. If the tension exerted by the threaded screw 29 is slight, then the loop length can be varied by pulling on the end portion 56 or middle portion 54. Conversely, if the tension is very high, then the slotted end portion 56 is firmly fixed. The inner end portion 52 of the loop strap 50 is intrinsically firmly fixed, since the fixing element 22 passes through the hole 58 of the loop strap 50.

If the pull for changing the length of the hand loop is exerted downward in the direction of the arrow 62, then the clamping element 28 is pressed downward and in the process clamps the part of the slotted end portion 56 located between the clamping element 28 and the bottom face 19 of the recess 18. To lengthen the hand loop 16, accordingly, an at least horizontal or upward-oriented pull must be exerted. If the threaded screw 29 is tightened slightly, the pulling force required to lengthen or shorten the hand loop 16 increases accordingly. This force can be continuously adjusted with the threaded screw 29.

The ends of the slot 60 define the longest and shortest loop length, when they are in contact with the fixing element 22.

The guide part 33 preferably has a marking on its visible face end to indicate the direction in which the annular disk 25 should be turned in order to tighten or loosen the clamping device (see FIG. 3).

Instead of a threaded screw, whose head is connected nonrotatably but axially movably to the annular disk 25, a threaded rod guided axially in the stick or pole handle could also be provided, in which case the annular disk then has a central internal thread with which the threaded rod is axially movably guided. For firmly clamping the loop strap 50, this threaded rod would have to have a shoulder.

Preferably, the actuating member 24 is accessible on the sides that face toward the palm of the hand when the pole or stick handle is in use. This is especially true when the second recess 18' that receives the actuating member 24 is introduced into the handle 10 from the same side as the first recess 18 that receives the loop strap 50.

Figure 4:
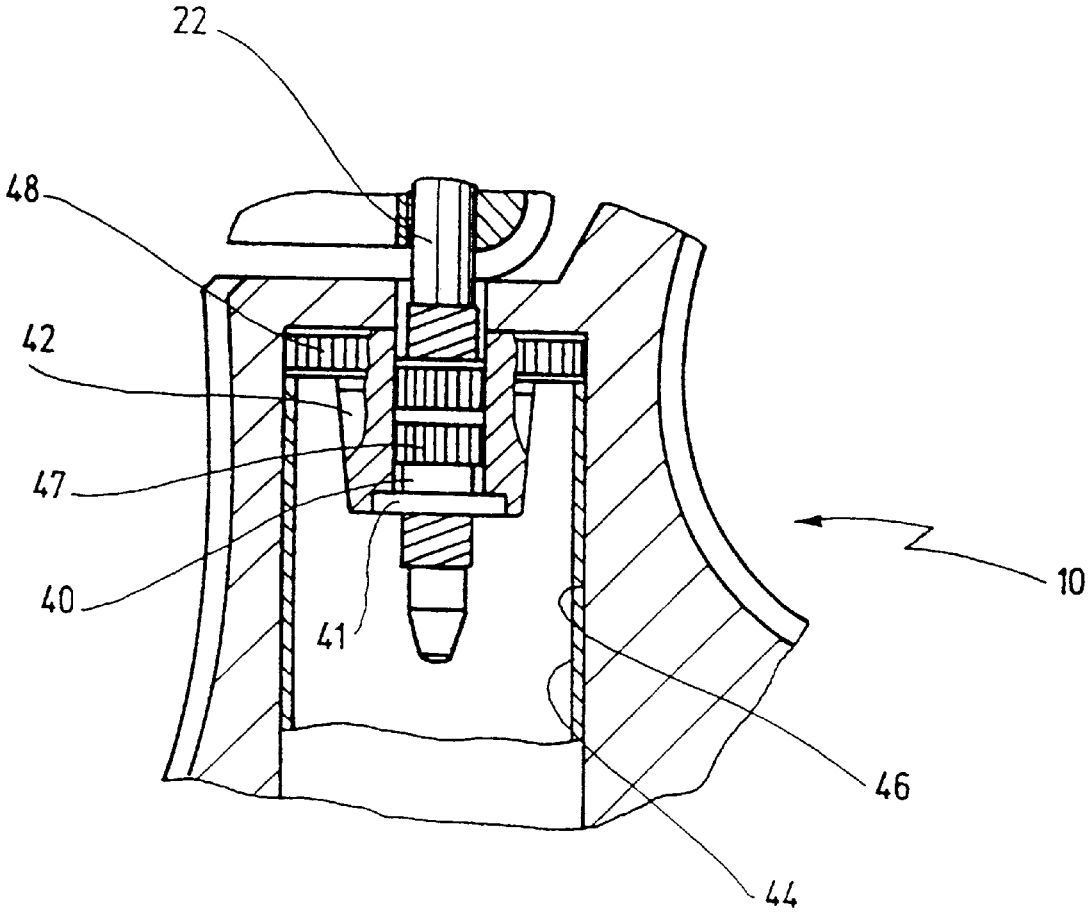

In a further embodiment of the present invention, shown in FIG. 4, the guide thread 27 is provided in a metal cuff 40, preferably a Rampa cuff. The cuff 40 is press-fitted into a plastic sheath 42, and the cuff 40 has a shoulder 41 in order to prevent the cuff from being torn out upward. The plastic sheath 42 is introduced into the handle from below, press-fitted into an axial recess 46 that receives a tube 44 of the stick or pole. The cuff 40 and the plastic sheath 42 have knurling 47 and 48, respectively, on the outer circumference, so that they are press-fitted into the plastic sheath 42 and handle 10, respectively, in a manner fixed against relative rotation.

What is claimed is:

1. A handle for a stick or pole in combination with a hand loop formed by a strap, comprising:

an endpiece;

a clamping device disposed in said endpiece, said clamping device having a clamping element encompassed by the strap forming the hand loop and disposed inside said endpiece;

a guide thread in said endpiece which extends in an axial direction;

a fixing element guided in said guide thread and extending through said clamping element together with the strap forming the hand loop, said fixing element being adjustable relative to said guide thread from outside of said endpiece, and the strap forming the hand loop having a variable length for forming a hand loop of varying length; and an actuating member rotatably supported in said endpiece, said actuating member being coaxially associated with said fixing element and said fixing element being nonrotatably connected to be axially movable relative to said actuating member.

2. A handle for a stick or pole in combination with a hand loop formed by a strap, comprising:

an endpiece;

a clamping device disposed in said endpiece, said clamping device having a clamping element encompassed by the loop strap and disposed inside said endpiece;

a guide thread in said endpiece which extends in an axial direction;

a fixing element guided in said guide thread and extending through said clamping element together with the loop strap, said fixing element being adjustable relative to said guide thread from outside of said endpiece; and an actuating member rotatably supported in said endpiece, said actuating member being coaxially associated with said fixing element and said fixing element being nonrotatably connected to be axially movable relative to said actuating member, wherein said endpiece defines a palm side, and wherein said actuating member is accessible from the side oriented toward said palm side of said endpiece, when the handle is in use.

3. A handle for a stick or pole in combination with a band loop formed by a strap, comprising:

an endpiece;

a clamping device disposed in said endpiece, said clamping device having a clamping element encompassed by the loop strap and disposed inside said endpiece;

a guide thread in said endpiece which extends in an axial direction;

a fixing element guided in said guide thread and extending through said clamping element together with the loop strap, said fixing element being adjustable relative to said guide thread from outside of said endpiece; and an actuating member rotatably supported in said endpiece, said actuating member being coaxially associated with said fixing element and said fixing element being nonrotatably connected to be axially movable relative to said actuating member, wherein:

said actuating member comprises an annular disk, and said fixing element comprises a thread screw, said annular disk being penetrated centrally by a head of said thread screw.

4. The handle as defined in claim 3, wherein said annular disk positively engages said endpiece and ends flush with a circumferential part of said endpiece.

5. The handle as defined in claim 3, wherein said annular disk has a knurled circumference.

6. A handle for a stick or pole in combination with a hand loop formed by a strap, comprising:

an endpiece;

a clamping device disposed in said endpiece, said clamping device having a clamping element encompassed by the loop strap and disposed inside said endpiece;

a guide thread in said endpiece which extends in an axial direction;

a fixing element guided in said guide thread and extending through said clamping element together with the loop strap, said fixing element being adjustable relative to said guide thread from outside of said endpiece; and an actuating member rotatably supported in said endpiece, said actuating member being coaxially associated with said fixing element and said fixing element being nonrotatably connected to but axially movable relative to said actuating member, wherein:

said fixing element includes a plastic sheath press-fitted into said endpiece, and a metal cuff introduced into said plastic sheath, and said guide thread being provided in said metal cuff.

* * * * *